US012714200B2

(12) United States Patent
Dealey et al.

(10) Patent No.: US 12,714,200 B2
(45) Date of Patent: Aug. 25, 2026

(54) UPPER FOR AN ARTICLE OF FOOTWEAR HAVING AN ELASTIC CABLE

(71) Applicant: NIKE, Inc., Beaverton, OR (US)

(72) Inventors: Stuart W. Dealey, Portland, OR (US); Derek A. Fitchett, Beaverton, OR (US); James Morales, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 874 days.

(21) Appl. No.: 16/887,614

(22) Filed: May 29, 2020

(65) Prior Publication Data

US 2020/0375316 A1 Dec. 3, 2020

Related U.S. Application Data

(60) Provisional application No. 62/863,660, filed on Jun. 19, 2019, provisional application No. 62/855,556, filed on May 31, 2019.

(51) Int. Cl.
*A43B 23/02* (2006.01)
*A43B 23/04* (2006.01)
(Continued)

(52) U.S. Cl.
CPC ..... *A43B 23/027* (2013.01); *A43B 23/025* (2013.01); *A43B 23/042* (2013.01); *D04B 1/24* (2013.01); *D04B 21/207* (2013.01)

(58) Field of Classification Search
CPC ..... D04B 21/207; D04B 1/24; A43B 23/042; A43B 23/025; A43B 23/027; A43B 5/08; A43C 11/002
(Continued)

(56) References Cited

U.S. PATENT DOCUMENTS 5,117,567 A 6/1992 Berger
5,566,474 A 10/1996 Leick et al.
(Continued)

FOREIGN PATENT DOCUMENTS

CN 203040850 U 7/2013
CN 104207410 A 12/2014
(Continued)

OTHER PUBLICATIONS

International Search Report and Written Opinion of the International Searching Authority in corresponding PCT Application No. PCT/US2020/034950 dated Sep. 16, 2020 (13 pages).
(Continued)

*Primary Examiner* — Alissa J Tompkins
*Assistant Examiner* — Catherine M Ferreira
(74) *Attorney, Agent, or Firm* — Shook, Hardy & Bacon L.L.P.

(57) ABSTRACT

A knitted component may form at least a portion of an upper for the article of footwear. The knitted component may include at least one tubular structure that has a first knit layer and a second knit layer, the first knit layer and the second knit layer being separable such that a channel is located between the first knit layer and the second knit layer. A cable may be located at least partially within the channel of the at least one tubular structure, where the cable extends continuously from a biteline of the article of footwear on a lateral side of the upper, through a throat area of the upper, and to the biteline on a medial side of the upper.

20 Claims, 5 Drawing Sheets

(51) Int. Cl.
*D04B 1/24* (2006.01)
*D04B 21/20* (2006.01)

(58) Field of Classification Search
USPC ..... 36/45, 51, 8.1
See application file for complete search history.

(56) References Cited

U.S. PATENT DOCUMENTS

| | | | | |
|---|---|---|---|---|
| 5,615,562 | A | 4/1997 | Roell | |
| 6,032,387 | A | 3/2000 | Johnson | |
| 6,117,332 | A | 9/2000 | Hatch et al. | |
| 6,922,917 | B2 | 8/2005 | Kerns et al. | |
| 7,222,504 | B2 | 5/2007 | Nakayama | |
| 7,281,341 | B2 | 10/2007 | Reagan et al. | |
| 8,522,577 | B2 | 9/2013 | Huffa | |
| 8,959,959 | B1 | 2/2015 | Podhajny | |
| 9,060,570 | B2 | 6/2015 | Huffa et al. | |
| 9,078,488 | B1 * | 7/2015 | Meir | A43B 23/04 |
| 9,404,205 | B2 * | 8/2016 | Meir | D04B 1/22 |
| 10,143,260 | B2 | 12/2018 | Mallen et al. | |
| D892,486 | S * | 8/2020 | Han | D2/972 |
| D925,208 | S * | 7/2021 | Nykreim | D2/978 |
| 11,122,850 | B2 * | 9/2021 | Hutchinson | D04B 1/22 |
| 2004/0181972 | A1 | 9/2004 | Csorba | |
| 2007/0011914 | A1 | 1/2007 | Keen et al. | |
| 2008/0301919 | A1 | 12/2008 | Ussher | |
| 2009/0199435 | A1 | 8/2009 | Robinson et al. | |
| 2010/0154256 | A1 | 6/2010 | Dua | |
| 2010/0175278 | A1 | 7/2010 | Seliger | |
| 2011/0030244 | A1 | 2/2011 | Motawi et al. | |
| 2011/0047821 | A1 | 3/2011 | Rosen | |
| 2012/0000091 | A1 | 1/2012 | Cotterman et al. | |
| 2012/0216423 | A1 * | 8/2012 | Lyden | A43B 1/0063 36/84 |
| 2013/0145652 | A1 | 6/2013 | Podhajny et al. | |
| 2014/0068968 | A1 * | 3/2014 | Podhajny | D04B 15/56 36/50.1 |
| 2014/0157627 | A1 | 6/2014 | Smaldone et al. | |
| 2014/0238082 | A1 | 8/2014 | Meir | |
| 2014/0245547 | A1 | 9/2014 | Baudouin et al. | |
| 2014/0310983 | A1 | 10/2014 | Tamm et al. | |
| 2015/0013188 | A1 | 1/2015 | Seamarks et al. | |
| 2015/0059206 | A1 | 3/2015 | Lovett et al. | |
| 2015/0082662 | A1 * | 3/2015 | Farris | A41F 9/002 2/322 |
| 2015/0296922 | A1 | 10/2015 | Rushbrook et al. | |
| 2015/0342304 | A1 | 12/2015 | Modena et al. | |
| 2016/0058100 | A1 | 3/2016 | Dealey et al. | |
| 2016/0088893 | A1 | 3/2016 | Meir | |
| 2016/0088899 | A1 * | 3/2016 | Liles | A43C 1/04 36/50.1 |
| 2016/0090670 | A1 * | 3/2016 | Meir | A43B 23/027 |
| 2016/0219983 | A1 | 8/2016 | Taylor | |
| 2016/0331083 | A1 | 11/2016 | Uesato | |
| 2017/0079366 | A1 * | 3/2017 | Cross | D04B 1/24 |
| 2017/0105489 | A1 | 4/2017 | Lovett | |
| 2017/0202295 | A1 * | 7/2017 | MacGilbert | D04B 1/123 |
| 2017/0238644 | A1 | 8/2017 | Meir et al. | |
| 2017/0265560 | A1 | 9/2017 | Beers et al. | |
| 2017/0265561 | A1 | 9/2017 | Beers et al. | |
| 2017/0265573 | A1 | 9/2017 | Beers et al. | |
| 2017/0265576 | A1 | 9/2017 | Beers et al. | |
| 2017/0280817 | A1 * | 10/2017 | Hutchinson | A41D 27/205 |
| 2018/0110296 | A1 | 4/2018 | Dombrow et al. | |
| 2018/0110298 | A1 | 4/2018 | Schneider et al. | |
| 2018/0153263 | A1 | 6/2018 | Beers et al. | |
| 2018/0168272 | A1 | 6/2018 | Droege et al. | |
| 2018/0199673 | A1 | 7/2018 | Schneider et al. | |
| 2018/0263338 | A1 | 9/2018 | Amis et al. | |
| 2018/0295942 | A1 | 10/2018 | Drake | |
| 2019/0037966 | A1 | 2/2019 | Aceves et al. | |
| 2019/0098963 | A1 | 4/2019 | Beers et al. | |
| 2019/0116935 | A1 | 4/2019 | Avar et al. | |
| 2019/0223556 | A1 * | 7/2019 | Aceves Tinajero | D04B 1/24 |
| 2019/0246745 | A1 | 8/2019 | Bock et al. | |
| 2019/0313742 | A1 | 10/2019 | Bell et al. | |

FOREIGN PATENT DOCUMENTS

| | | | |
|---|---|---|---|
| CN | 104886862 | A | 9/2015 |
| CN | 105209676 | A | 12/2015 |
| CN | 105407753 | A | 3/2016 |
| CN | 105595525 | A | 5/2016 |
| CN | 205624633 | U | 10/2016 |
| CN | 108471840 | A | 8/2018 |
| CN | 108697190 | A | 10/2018 |
| CN | 207927884 | U | 10/2018 |
| JP | 2017-531473 | A | 10/2017 |
| KR | 2015-0005610 | A | 1/2015 |
| KR | 2015-0009994 | A | 1/2015 |
| KR | 10-2581626 | B1 | 9/2023 |

OTHER PUBLICATIONS

International Preliminary Report on Patentability received for PCT Patent Application No. PCT/US2020/034950, mailed on Dec. 9, 2021, 9 pages.

International Search Report and Written Opinion dated Nov. 19, 2020 in International Patent Application No. PCT/US2020/037530, 18 pages.

Office Action received for European Application No. 20735759.1, mailed on Apr. 17, 2024, 7 pages.

Non-Final Office Action received for U.S. Appl. No. 18/648,927, mailed on Jan. 16, 2025, 13 pages.

Notice of Allowance received for U.S. Appl. No. 18/648,927, mailed on Jul. 7, 2025, 9 pages.

Office Action received for European Application No. 20735759.1, mailed on Jul. 23, 2025, 5 pages.

* cited by examiner

UPPER FOR AN ARTICLE OF FOOTWEAR HAVING AN ELASTIC CABLE

RELATED APPLICATIONS

This application claims the benefit of U.S. Provisional Application No. 62/855,556, filed May 31, 2019, which is hereby incorporated by reference in its entirety. This application also claims the benefit of U.S. Provisional Application No. 62/863,660, filed Jun. 19, 2019, which is hereby incorporated by reference in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate similar or identical features.

DETAILED DESCRIPTION

Figure 1:
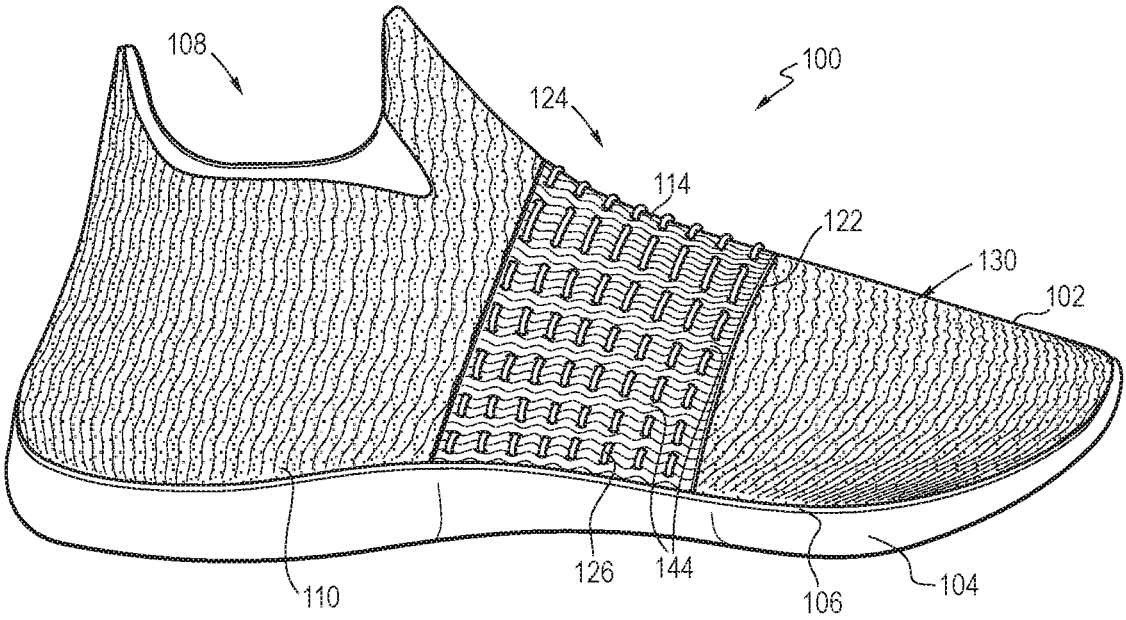
FIG. 1 is an illustration showing an article of footwear having an elastic cable in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

FIG. 1 is an illustration showing an example of an article of footwear 100 having an upper 102 that is secured to a sole structure 104. The area where the sole structure 104 joins the upper 102 may be referred to as a biteline 106. The upper 102 may be at least partially formed by a knitted component 122, and be joined to the sole structure 104 in a fixed manner using any suitable technique, such as through the use of an adhesive, by sewing, etc. The sole structure 104 may define the bottom surface of a void for receiving and accommodating a user's foot. The void may be accessible through an ankle opening 108.

Figure 2:
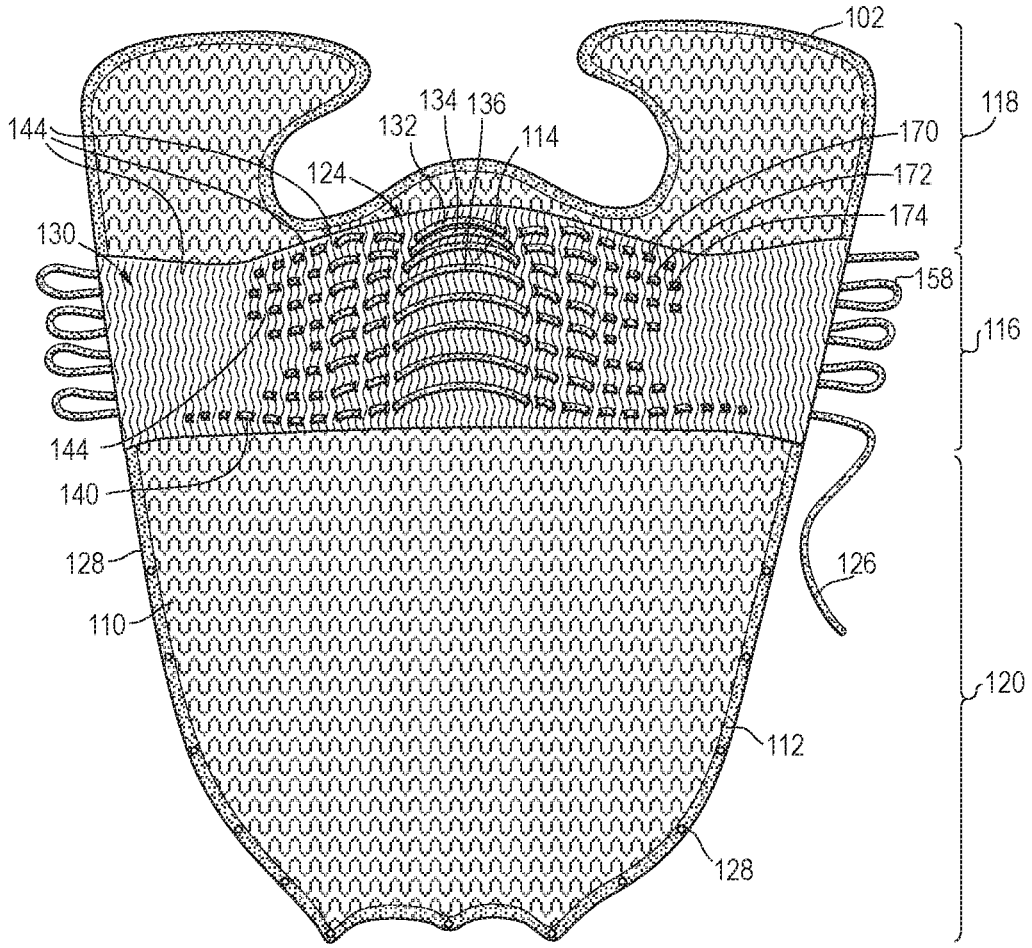
FIG. 2 is an illustration showing an upper for an article of footwear having an elastic cable in accordance with certain aspects of the present disclosure.

Referring to FIG. 2, which shows the knitted component 122 as it may appear after knitting but prior to being manipulated into a wearable shape to form the upper 102, the upper 102 may include a lateral side 110 and a medial side 112. A throat area 114 may be included between the lateral side 110 and the medial side 112, and the throat area 114 may be positioned to cover the top (dorsal) surface of the foot during typical use. A midfoot area 116 of the upper 102 may be located between a heel area 118 and a toe area 120. The throat area 114 may be primarily located in the midfoot area 116. In some embodiments, an optional tongue may be disposed at least partially in the throat area 114.

At least a portion of the upper 102 may be formed with a knitted component 122 (or another suitable textile component). For example, the upper 102 may be formed primarily as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted components without the need for significant post-knitting processes or steps. Alternatively, the knitted component 122 may be formed separately as distinct integral one-piece elements and then the respective elements attached (e.g., via sewing).

Forming the upper with a knitted component 122 may impart advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The weight of the upper 102, and thus the overall weight of the article of footwear 100, may be reduced with respect to alternative uppers and/or other components that are typically used in footwear. The knitted component 122 may also provide desirable aesthetic characteristics by incorporating yarns having different colors, textures or other visual properties arranged in a particular pattern. The yarns themselves and/or the knit structure formed by one or more of the yarns of the knitted components may be varied at different locations to provide different knit portions with different properties (e.g., a portion forming the throat area 114 of the knitted component 122 may be relatively elastic while a portion forming the heel area 118 or another area may be relatively inelastic).

In some embodiments, the knitted component 122 may incorporate one or more materials with properties that change in response to a stimulus (e.g., temperature, moisture, electrical current, magnetic field, or light). For example, as described in more detail below, the knitted component 122 may include yarns formed of a thermoplastic polymer material (e.g., a polyurethane, polyamide, polyolefin, and/or nylon) that transitions from a solid state to a softened or liquid state when subjected to certain temperatures at or above its melting point and then transitions back to the solid state when cooled. The thermoplastic polymer material may provide the ability to heat and then cool a portion of the knitted component 122 to thereby form an area of bonded or continuous material (herein referred to as a "fused area") that exhibits certain advantageous properties including a relatively high degree of rigidity, strength, and water resistance, for example.

As shown in FIGS. 1-2, the article of footwear 100 may include a tensioning system 124 that affects the geometry of the upper 102 such that the upper 102 properly fits the foot of a user and remains on the user's foot during normal use. In typical articles of footwear, a shoelace is used. Instead of a shoelace (though a shoelace may additionally be included in contemplated embodiments), the present embodiment includes at least one elastic cable 126 extending over the foot of a wearer (when the article of footwear 100 is in use). As shown, the cable 126 may extend across the throat area 114 of the upper 102. For example, the cable 126 may extend from the biteline 106 on the lateral side 110 of the upper 102 to the biteline 106 on the medial side 112 of the upper 102 continuously, and without substantially changing its direction of extension relative to the coursewise direction of the knitted component 122 (which extends medial-to-lateral in the depicted embodiment, although individual courses are not shown). Additionally or alternatively, the cable 126 may extend to an outer perimeter edge 128 of the upper 102 (shown in FIG. 2) on the lateral side 110 of the upper 102 and also to the outer perimeter edge 128 on the medial side 112 of the upper 102 (e.g., along the coursewise direction of the knitted component 122).

The cable 126 may have a particular elasticity selected for providing a comfortable fit and/or sufficient resistance to footwear removal during use of the article of footwear 100. In some embodiments, for example, the cable 126 may be formed of a relatively elastic material (e.g., a selected amount of spandex) such that the cable 126 has a higher elasticity than the underlying material of the upper 102 (e.g., knitted loops) (or vice versa), at least in the throat area 114. For example, the elasticity of the cable 126, and/or its relative tested elongation, may be at least about 20% greater than an elasticity or tested elongation of the underlying material of the upper 102 (e.g., in the throat area 114) when tested in accordance with ATSM D4964-96 (2016). More particularly, when tested in accordance with this standard, the elasticity of the cable 126 (tested alone) may be about 50% greater, such as about 100% greater, than that of the underlying layer(s) of the upper 102 (and it is contemplated that, in other embodiments, the two components may have relatively similar elasticities, or the underlying layer(s) of the upper 102 may have a greater elasticity). Further, the cable 126 may have the ability to elongate a substantial amount (e.g., up to 200% or more in some instances) while retaining relatively constant elastic properties. Thus, while an underlying layer of the upper 102 may have a relatively narrow range of elongation, the relatively-high elongation properties of the cable 126 (per the above-described ASTM standard) may provide enhanced fit of the article of footwear 100 by ensuring a relative-constant retention force for maintaining the article of footwear 100 on a user's foot.

The cable 126 may extend at least partially through the remainder of the upper 102 in any suitable manner. For example, as described in more detail below, the cable 126 may be placed within one or more tubes 144 (which may be formed by courses of the knitted component 122) during a knitting process (e.g., during formation on a knitting machine). Placing the cable 126 within the tubes 144 during a knitting process has various advantages, some of which are described below. When the cable 126 is placed within the tubes 144 (formed by courses of the knitted component 122) during a knitting process, the knitted component 122 may comprise the cable 126 (i.e., since the knitting process includes insertion of the cable 126 within respective tubes). Alternatively, the cable 126 may be fed through the tubes 144 after the knitted component 122 after the knitted component 122 is formed.

As shown in FIG. 2, the cable 126 may include a plurality of sections that extend between the perimeter edge 128 over the throat area, such as a first section 170, a second section 172, a third section 174, and so on. For example, the present embodiment includes eight (8) sections each spaced in the upper's longitudinal direction (i.e., heel-to-toe), but an alternative number may be selected. Without limitation, the cable 126 may include between about one (1) section and about thirty (30) sections, and more specifically between about four (4) sections and about ten (10) sections in certain exemplary embodiments. More sections may be used, particularly if sections are located closer to the toe area 120 of the upper 102 relative to what is depicted in FIG. 2 (and it is contemplated that certain cable sections may be located in the toe area 120). Certain ranges, such as between about four (4) sections and about ten (10) sections when covering only the throat area 114, may be particularly desirable due to the balance between manufacturing efficiently, cost, and material usage while also providing a suitable distribution of the retention force(s) caused by the cable 126 over a relatively large surface area, thus reducing "hot spots," or spots where a concentrated force causes foot discomfort.

In the depicted embodiment of FIG. 2, the cable 126 extends in a serpentine pattern, and therefore one continuous cable 126 comprises all of the sections 170, 172, 174, etc. The sections of the cable 126 that extend beyond the perimeter edge 128 of the knitted component 122, and between respective sections, are referred to herein as linking sections 158. If the cable 126 is inlaid during a knitting process (as discussed below), the linking sections 158 may be the result of an inlay feeder (inlaying the cable 126) extending beyond the perimeter edge 128 of the knitted component 122 during the knitting process (e.g., while the inlay feeder changes directions after one inlay process (corresponding to the first section 170) and prior to performing the next inlay process in the opposite direction (corresponding to the second section 172)).

In some embodiments, one or more of the linking sections 158 may be secured (e.g., fixed) relative to the sole structure and/or perimeter edge 128 such that the sections of the cable 126 retain a similar length, tension, etc. during use. Such securement may occur after knitting and via sewing, application of an adhesive, etc. Alternatively, the linking sections 158 may remain unfixed relative to other components such that, during use, a force/tension on one section of the cable 126 may be distributed to other section(s) during footwear use. This may be advantageous for reducing hot spots, providing an adaptable fit to different foot shapes, etc. As described in more detail below, the linking sections 158 may be manipulated during shoe assembly, and/or adjustable/customizable in an assembled article of footwear, such that the length of the sections of the cable 126 are optimized for certain footwear sizes, types, functions, etc.

Figure 3:
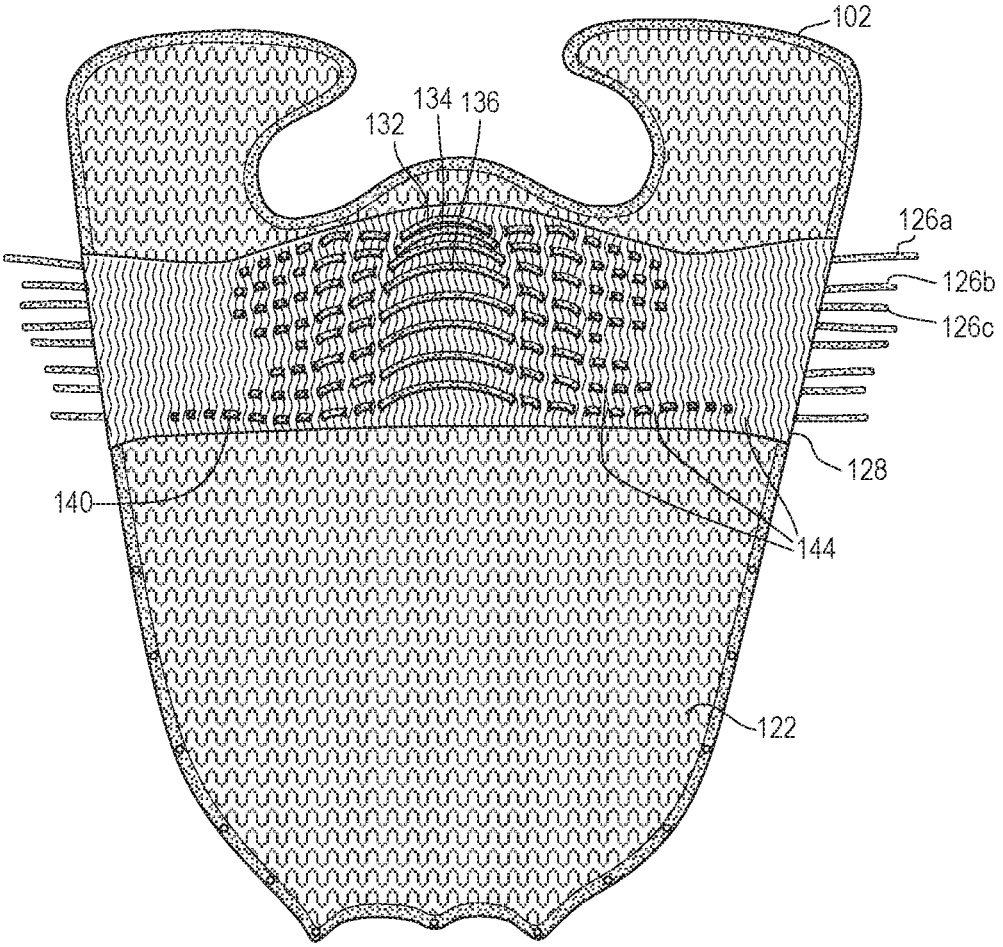
FIG. 3 is an illustration showing another embodiment of an upper for an article of footwear having elastic cable in accordance with certain aspects of the present disclosure.

As shown in FIG. 3, some embodiments of the upper 102 may include separate cables 126*a*, 126*b*, 126*c*, etc. rather than one continuous cable (and, while not shown, it is contemplated that certain cable sections may include distinct cables, while others in the same article of footwear may be separate sections of one continuous cable). To form the upper 102, each separate cable 126*a*, 126*b*, 126*c*, etc. may be inserted separately (e.g., during an inlay process), or one cable may first be inserted (e.g., during knitting) and then cut. Without limitation, the embodiment of FIG. 3 may be advantageous for isolating different cable sections from a force-distribution perspective (in applications where such isolation is desirable), and/or for reducing the amount of material near the perimeter edge 128 of the knitted component 122 to preventing interference with bonding between the upper 102 and another component (e.g., a sole structure) when certain bonding methods are used.

The cable 126 may have certain portions that are exposed relative to the exterior surface 130 of the knitted component 122 (i.e., wherein "exposed relative to a surface of the knit element" herein means not covered by loops of yarn forming courses of the knit element). Other portions may alternatively be within a tube 144 and/or otherwise covered by intermeshed loops of the knitted component 122 (at least from an external perspective), and therefore not visible and/or not physically accessible (e.g., to grabbing) to a user from an external reference point. For example, the first section 170 (or 126*a* in FIG. 3) may include a first exposed portion 132, the second section 172 (or 126*b* in FIG. 3) may include a second exposed portion 134, the third section 174 (or 126*c* in FIG. 3) may include a third exposed portion 136, etc. These exposed portions may be located in the throat area 114, and more specifically the area that is typically occupied by a shoelace in other articles of footwear, for example. Advantageously, a user may have the ability to grab and adjust one or more of the exposed portions, for example. While any suitable length may be used, in some embodiments, the exposed portions 132, 134, 136, etc. may have a length of about 10 mm or more (and notably, the embodiment of FIG. 1 shows their length being relatively short when compared to FIGS. 2-3, and perhaps less than about 10 mm). Further, particularly when two needle beds are used to form the knitted component, exposing the portions of the cable 126 in the throat area 114 may allow for extra cushioning (for comfort) beneath the cable (further distributing potential hot spots) since a full double jersey knit structure may be located between the cable 126 and a user's foot.

Optionally, the exposed portions 132, 134, 136, etc. may include slack when the upper 102 is not worn, but may be relatively taut when the knitted component 122 at least partially stretches around a foot when the article of footwear 100 is worn. For example, as shown in FIG. 2, the exposed portions in the throat area 114 have slack and curve slightly away from the underlying fabric of the throat area 114, but those same portions may be substantially taut once the upper 102 is in use and worn (e.g., as shown by the cable 126 in FIG. 1). Advantageously, such an embodiment may provide relative ease of foot entry while also providing sufficient resistance to footwear removal when the article of footwear 100 is in use.

In addition (or as an alternative) to those described above, additional exposed portions of the cable 126 may also exist, such as the fifth exposed portion 140 and/or other similar exposed portions depicted in FIGS. 1-3. While any suitable length is contemplated for the additional exposed portions (if included), in some instances their length may be about 10 mm or less. These additional exposed portions may be primarily ornamental, but in certain embodiments they may have functional properties. For example, it is contemplated that a user may grip the fifth exposed portion 140 for adjustability, the fifth exposed portion 140 may be selectively sized and located to provide specific friction characteristics (e.g., more and/or larger exposed areas may reduce the overall static and/or dynamic friction forces between the tubes 144 and the cable 126, or the like), etc. While not shown, it is also contemplated that at least one section of the cable 126 may wholly lack exposed portions such that the cable 126 is not visible (or substantially not visible) from an external perspective.

As described in more detail below, at least a portion of the cable 126 may be inlaid between certain loops of the knitted component 122 on a knitting machine during the manufacturing of the knitted component 122. For example, the cable 126 may be inserted within the tube 144 during a knitting process, such as by utilizing an inlay process. For example, an inlay process may include using an inlay feeder or other mechanical inlay device on a knitting machine (e.g., a combination feeder) to place the cable 126 between two needle beds (e.g., front and back needle beds) during a knitting process. One example of an inlay process, along with a combination feeder for enabling such a process, is described in U.S. Patent Application Publication No. 2013/0145652, published Jun. 13, 2013, and having an applicant of NIKE, Inc., which is hereby incorporated by reference in its entirety. Alternatively, the cable 126 may be fed through the tubes 144 of the knitted component 122 by hand. It is contemplated that the cable 126 may be attached to the remainder of the upper 102 in a different way (e.g., other than being located in a tube), such as by using an adhesive to secure the cable 126 directly to the exterior surface 130 of the upper 102.

Figure 4:
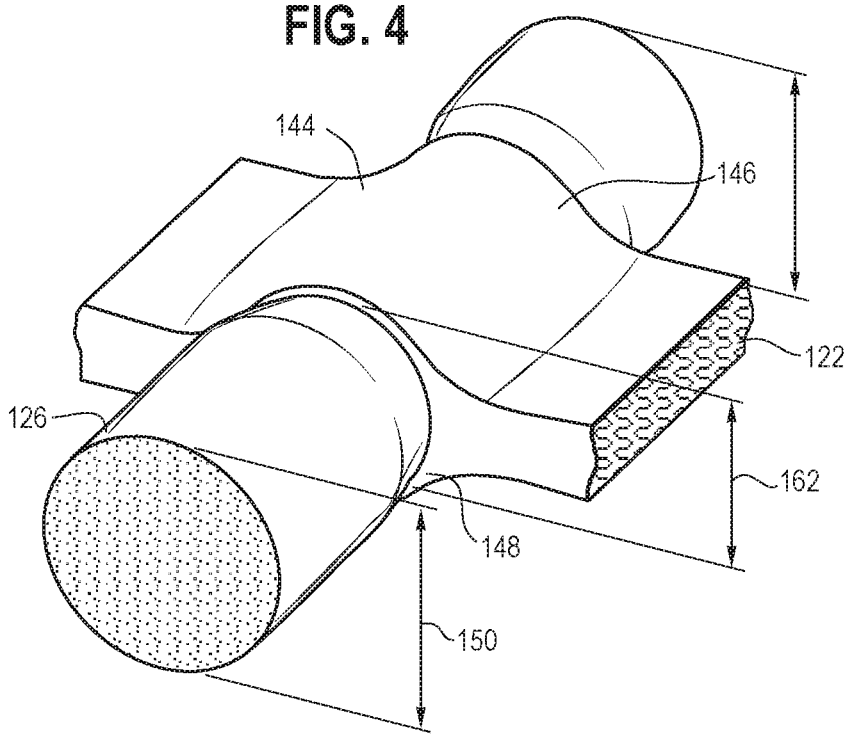
FIG. 4 is an illustration showing a knitted tube and a cable extending therethrough in accordance with certain aspects of the present disclosure.
Figure 5:
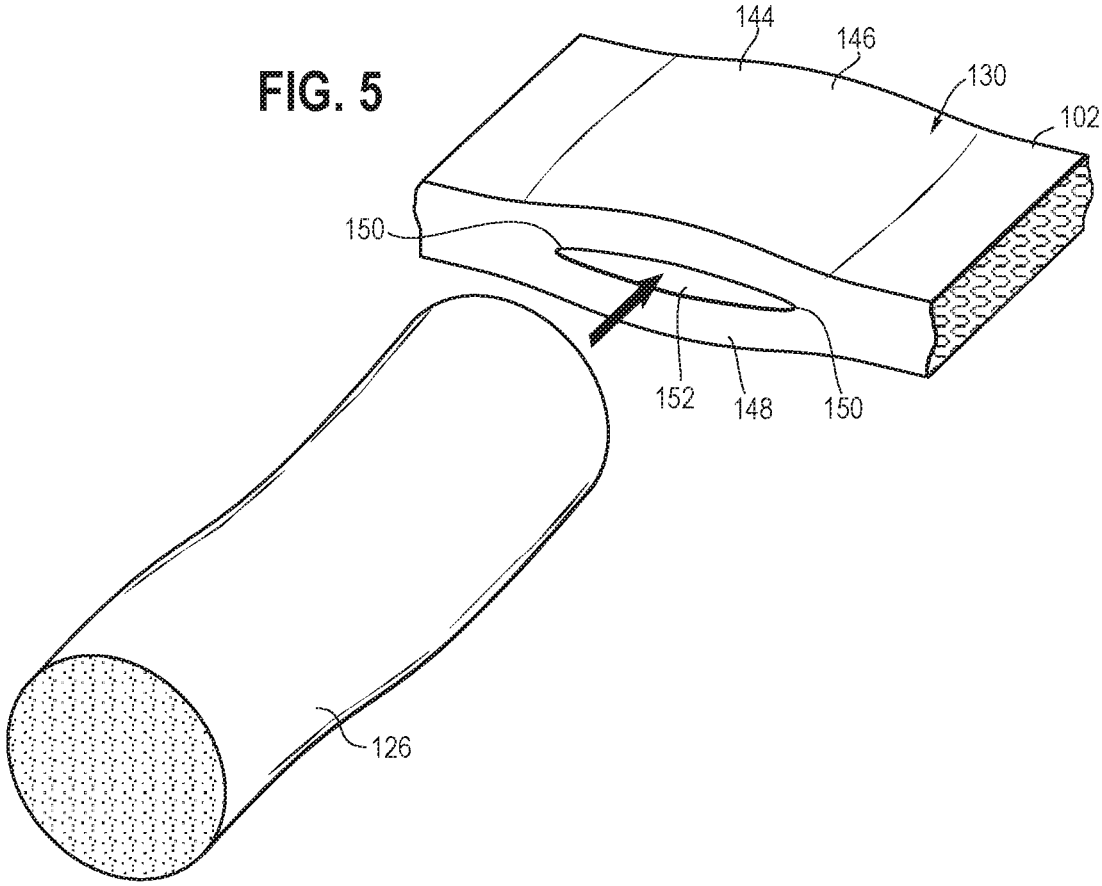
FIG. 5 is an illustration showing the knitted tube of FIG. 4 where the cable has been removed from the tube.

FIG. 4 shows a view of a single knit tube 144 of the upper 102 with the cable 126 located therein, and FIG. 5 shows the tube 144 without a cable 126 in its channel. Referring to FIGS. 4-5, the tube 144, as shown, is generally a hollow structure formed by two overlapping and at least partially coextensive layers of knitted material. Although the sides or edges of one layer of the knitted material forming the tube 144 may be secured to the other layer (e.g., if a two-layer construction extends beyond the tube 144), a central area is generally unsecured such that another element (e.g., the cable 126) may be located between the two layers of knitted material and pass through tube 144.

More specifically, the single tube 144 may be formed by a multi-layer knit structure, such as a tubular knit structure. The tubular knit structure may be formed by a tubular knitting process where a first knit layer formed on a first bed of the knitting machine remains separable from (e.g., having a central area not locked to) a second knit layer formed on a second needle bed for a plurality of courses. For example, a first layer 146 of the tube 144, which may define the exterior surface 130 of the knitted component 122, may be formed on a first needle bed of a knitting machine (e.g., with a single-jersey or similar knit structure). A second layer 148 of the tube 144, which may define an inner surface of the knitted component 122, may be formed on a second needle bed of the knitting machine (e.g., with a single-jersey or similar knit structure). The edges 150 of the tube 144 (which extend along the tube's length) may be locations where a course at the end of the tubular knit structure (in the knitting direction) utilizes both needle beds, thus locking the first layer 146 and the second layer 148 together. In the resulting knitted component 122, a channel/tunnel may be formed between the first layer 146 and the second layer 148 of the tube 144, and that same channel may be used for receipt of the cable 126.

Notably, the first layer 146 and the second layer 148 may each comprise a plurality of single-jersey knit courses such that the tube 144 is large enough to receive the cable 126. For example, each of the first layer 146 and the second layer 148 may include at least 3 consecutive courses, such as at least 5 consecutive courses. More courses (e.g., 10 consecutive courses or more) may be used when a larger cable is utilized. While the first layer 146 and the second layer 148 may have the same number of courses (e.g., such that they have the same size, as shown), they may alternatively include a different number of courses and/or otherwise be differently sized (which may cause the cable 126 to have an offset orientation relative to a plane centralized between the opposite faces of the knitted component).

Optionally, referring to FIG. 5, a channel 152 extending through the tube 144 may have a default state (i.e., a state where the first layer 146 and the second layer 148 are unstretched) where its diameter (when manipulated into a circular shape) is about the same size as, or smaller than, a default (uncompressed) diameter of the cable 126. While any suitable size is contemplated, certain embodiments may utilize a cable 126 with a diameter of about 2 mm. For example, as shown in FIG. 4, a default diameter 160 of the cable 126 may be larger than a compressed diameter 162 of the cable 126, where the default diameter 160 is located outside the channel of the tube 144 and where the compressed diameter 162 is located inside the channel of the tube 144. Specifically, the default diameter 160 may be at least about 3% larger than the compressed diameter 162, such as at least 5% larger, at least about 10% larger, at least about 20% larger, at least about 50% larger, etc. To measure the default diameter, a portion of the cable 126 outside of a tube may be measured, and/or the upper may be disassembled (e.g., via cutting away the tube) such that an uncompressed measurement may be taken. To measure the compressed diameter 162, a measurement of the cable diameter may be taken within (or immediately adjacent to) a tube.

Similarly, the first layer 146 and the second layer 148 may be stretched (relative to default state) when the cable 126 is inserted within the tube 144. For example, the shortest distance of the first layer 146, and/or second layer 148, along the perimeter of the channel from one edge 150 to the other may be at least 3% larger when in a stretched state (i.e., due to outward force provided by cable compression) than when in an unstretched state, such as at least 5% larger, at least about 10% larger, at least about 20% larger, at least about 50% larger, etc. Upon analyzing this feature, the above-mentioned distance may be measured when the cable is removed (e.g., which may include disassembly of the article of footwear) to determine the above-mentioned distance in an unstretched distance, and the above-mentioned distance in the stretched state may be determined while the cable is within the tube.

Advantageously, the compression of the cable 126 within the tube 144, and/or the effect (e.g., stretching) on the layers forming the tube 144, may provide specific friction-related characteristics between the cable 126 and the tube 144 for optimal performance of the cable 126, enhanced durability, enhanced comfort, or the like. Notably, such compression of the cable 126 (or stretching of the tube 144), or even having the cable 126 being about the same size as (or being slightly larger than) the channel of the tube 144, may cause extreme difficulty of placing the cable 126 within the tube 144 by hand (e.g., after a knitting process). For example, hand-placement may be tedious and inefficient, and in some instances even unachievable. Thus, in certain embodiments, utilizing an inlay procedure on a knitting machine may be advantageous for providing the ability for placing the cable 126 within the tube 144 during formation of the first layer 146 and the second layer 148, and prior to formation of at least one edge 150, is advantageous for providing a viable, efficient process for forming the upper.

Figure 6:
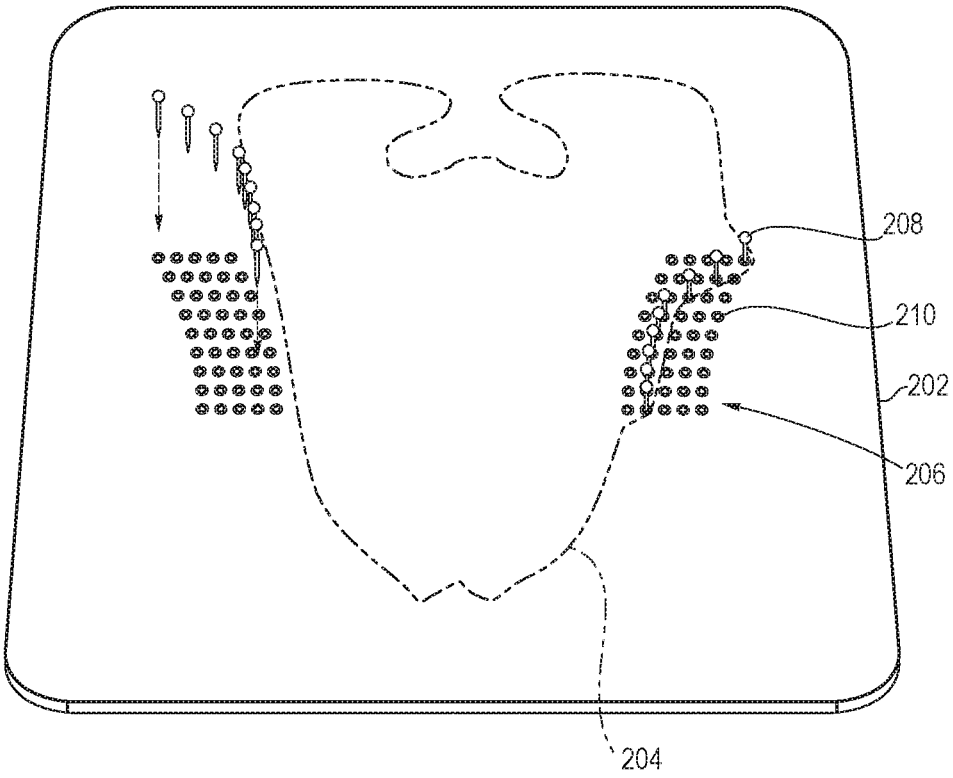
FIG. 6 is an illustration showing a jig having an adjustable fastening system in accordance with certain aspects of the present disclosure.

FIG. 6 shows an embodiment of a jig 202 which may be used to manipulate the upper 102 described above during manufacturing. For example, the jig 202 may hold the upper 102 during manufacturing steps, such as heating (e.g., steaming), printing (e.g., a logo), securing other components to the upper, insertion of the above-described cable (if not already inserted into tubes on a knitting machine), etc. An outer workpiece perimeter 204 of the jig 202, which may include a set of pins or other fasteners, may generally track an outer perimeter edge of the upper.

An additional set of fasteners 206 may be included for communication with the above-described cable 126 (see FIG. 2), and specifically the linking sections 158 (FIG. 2). For example, the fasteners 206 may include pins 208 that correspond with pin holes 210. To accommodate cables of different lengths (e.g., due to the size of the upper, the desired length and/or tension of the cable, etc.), multiple pin holes 210 may be associated with each pin 208, allowing a worker to select an appropriate pin hole 210 in view of a desired set of footwear characteristics. The pins 208 may hold the cable 126 (FIG. 2) during steaming and/or another manufacturing step. It is contemplated that, when the cable 126 (FIG. 2) will be fixed to the perimeter edge of the upper and/or cut, the pin 208 may be selectively located to ensure that each section of the cable 126 (FIG. 2) has a suitable length. Having described various aspects of the subject matter above, additional disclosure is provided below that may be consistent with the claims originally filed with this disclosure. In describing this additional subject matter, reference may be made to the previously described figures. One general aspect includes an article of footwear, including: a knitted component at least partially forming an upper for the article of footwear, where the knitted component includes at least one tubular structure including a first knit layer and a second knit layer, the first knit layer and the second knit layer being separable such that a channel is located between the first knit layer and the second knit layer; and a cable located at least partially within the channel of the at least one tubular structure, where the cable extends continuously from a biteline of the article of footwear on a lateral side of the upper, through a throat area of the upper, and to the biteline on a medial side of the upper. In some embodiments, the cable includes a first section and a second section, where the first section of the cable extends from the biteline on the lateral side of the upper, through the throat area of the upper at a first location, and to the biteline on the medial side of the upper, where the second section of the cable extends from the biteline on the lateral side of the upper, through the throat area of the upper at a second location, and to the biteline on the medial side of the upper, and where the first location is spaced from the second location in a longitudinal direction of the article of footwear. The article of footwear may further include a third section extending through the throat area at a third location, where the cable extends in a serpentine pattern through the upper from the first section, through the second section, and to the third section. The first section of the cable and the second section of the cable may be connected via a linking section of the cable, where the linking section of the cable extends beyond a terminal edge of the knitted component. Optionally, a second cable may be included that is discontinuous from the cable, where the cable extends from the biteline on the lateral side of the upper, through the throat area of the upper at a first location, and to the biteline on the medial side of the upper, where the second cable extends from the biteline on the lateral side of the upper, through the throat area of the upper at a second location, and to the biteline on the medial side of the upper, and where the first location is spaced from the second location in a longitudinal direction of the article of footwear. A default diameter of the cable may be larger than a default diameter of the channel of the at least one tubular structure. A compressed diameter of the cable, located within the channel of the at least one tubular structure, may be at least about 3% less than the default diameter of the cable. A portion of the knitted component defining the throat area of the upper may include a first elasticity, where the cable includes a second elasticity in the throat area, and where the first elasticity is greater than the second elasticity. In some embodiments, the cable is inlaid within the channel during a knitting process on a knitting machine. Another general aspect includes an article of footwear, including: a knitted component at least partially forming an upper for the article of footwear, where the knitted component includes at least one tubular structure including a first knit layer and a second knit layer, the first knit layer and the second knit layer being separable such that a channel is located between the first knit layer and the second knit layer; and a cable extending continuously from a biteline of the article of footwear on a lateral side of the upper, through a throat area of the upper, and to the biteline on a medial side of the upper, where the cable includes a first covered segment on the lateral side of the upper, where the cable includes a second covered segment on the medial side of the upper, and where the cable includes an exposed portion located in the throat area of the upper, the exposed portion extending from the first covered segment of the cable to the second covered segment of the cable. Another general aspect includes a knitted component at least partially forming an upper for an article of footwear, the knitted component including: at least one tubular structure including a first knit layer and a second knit layer, the first knit layer and the second knit layer being separable such that a channel is located between the first knit layer and the second knit layer; and a cable located at least partially within the channel of the at least one tubular structure, where at least one section of the cable extends continuously from a perimeter edge on a first side of the knitted component, through a central area forming a throat area of the upper, and to the perimeter edge on a second side of the knitted component. Optionally, a default diameter of the cable is equal to or greater than a default diameter of the channel of the at least one tubular structure. While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. A knitted component at least partially forming an upper for an article of footwear, the knitted component comprising:

a first knit layer and a second knit layer located in a midfoot region of the upper and comprising at least part of a tensioning system, the tensioning system comprising:

at least one tubular structure comprising a secured portion where the first knit layer is secured to the second knit layer and an unsecured portion where the first knit layer and the second knit layer are separable such that a channel is formed between the first knit layer and the second knit layer; and a cable that extends at least partially within the channel of the at least one tubular structure, wherein a first default diameter of the cable is larger than a second default diameter of the channel, such that the first default diameter of the cable in an exposed portion outside the channel is at least 3% larger than a compressed diameter of the cable inside the channel, wherein, in the midfoot region of the upper, the cable extends continuously from a biteline of the article of footwear on a medial side of the upper, over a throat area, and to the biteline of the article of footwear on a lateral side of the upper.

2. The knitted component of claim 1, wherein the cable is inlaid within the channel during a knitting process on a knitting machine.

3. The knitted component of claim 1, wherein the cable includes a first covered segment on the medial side of the knitted component, wherein the cable includes a second covered segment on the lateral side of the knitted component, and wherein the cable includes an exposed portion located in the throat area of the upper.

4. The knitted component of claim 3, wherein the upper comprises a first state corresponding to a default geometry, wherein the upper comprises a second state corresponding to a foot-worn geometry, and wherein when moving from the first state to the second state, a portion of the knitted component, located in the throat area of the upper, stretches such that the medial side of the throat area of the upper moves away from the lateral side of the throat area of the upper.

5. The knitted component of claim 4, wherein the exposed portion of the cable includes slack when the upper is in the first state such that the exposed portion of the cable stretches less than the portion of the knitted component when the upper moves from the first state to the second state.

6. The knitted component of claim 1, wherein the cable includes a first section and a second section, wherein the first section of the cable extends from the biteline on the medial side of the knitted component, through the throat area of the upper at a first location, and to the biteline on the lateral side of the knitted component, wherein the second section of the cable extends from the biteline on the medial side of the knitted component, through the throat area of the upper at a second location, and to the biteline on the lateral side of the knitted component, and wherein the first location is spaced from the second location in a longitudinal direction of the article of footwear.

7. The knitted component of claim 6, further comprising a third section extending through the throat area at a third location, wherein the cable extends in a serpentine pattern through the upper from the first section, through the second section, and to the third section.

8. The knitted component of claim 6, wherein the first section of the cable and the second section of the cable are connected via a linking section of the cable, and wherein the linking section of the cable extends beyond a terminal edge of the knitted component.

9. The knitted component of claim 1, further comprising a second cable that is discontinuous from the cable, wherein the cable extends from the biteline on the medial side of the knitted component, through the throat area of the upper at a first location, and to the biteline on the lateral side of the knitted component, wherein the second cable extends from the biteline on the medial side of the knitted component, through the throat area of the upper at a second location, and to the biteline on the lateral side of the knitted component, and wherein the first location is spaced from the second location in a longitudinal direction of the article of footwear.

10. The knitted component of claim 1, wherein a portion of the knitted component forming the throat area of the upper comprises a first elasticity, wherein in the midfoot region, the cable comprises a second elasticity, and wherein the second elasticity of the cable is greater than the first elasticity of the portion of the knitted component forming the throat area of the upper.

11. A knitted component at least partially forming an upper for an article of footwear, the knitted component comprising:

a first knit layer and a second knit layer forming at least a midfoot region of the upper, the midfoot region comprising:

at least one knitted tubular structure comprising a secured portion where the first knit layer and the second knit layer are secured to each other and an unsecured portion where the first knit layer and the second knit layer are separable such that a channel is formed between the first knit layer and the second knit layer; and a cable extending at least partially within the channel of the at least one knitted tubular structure, wherein a first default diameter of the cable outside of the channel is larger than a second default diameter of the channel and is at least 3% larger than a compressed diameter of the cable inside of the channel of the at least one knitted tubular structure.

12. The knitted component of claim 11, wherein the cable is inlaid within the channel during a knitting process on a knitting machine.

13. The knitted component of claim 11, wherein the cable includes a first covered segment on a medial side of the knitted component, wherein the cable includes a second covered segment on a lateral side of the knitted component, and wherein the cable includes an exposed portion located in a throat area of the upper between the medial side and the lateral side of the knitted component.

14. The knitted component of claim 11, wherein the cable includes a first section and a second section, wherein the first section of the cable extends from a biteline of the article of footwear on a medial side of the knitted component, through a throat area of the upper at a first location, and to the biteline on a lateral side of the knitted component, wherein the second section of the cable extends from the biteline on the medial side of the knitted component, through the throat area of the upper at a second location, and to the biteline on the lateral side of the knitted component, and wherein the first location is spaced from the second location in a longitudinal direction of the article of footwear.

15. The knitted component of claim 14, further comprising a third section extending through the throat area at a third location, wherein the cable extends in a serpentine pattern through the upper from the first section, through the second section, and to the third section.

16. The knitted component of claim 14, wherein the first section of the cable and the second section of the cable are connected via a linking section of the cable, and wherein the linking section of the cable extends beyond a terminal edge of the knitted component.

17. The knitted component of claim 11, further comprising a second cable that is discontinuous from the cable, wherein the cable extends from a biteline on a medial side of the knitted component, through a throat area of the upper at a first location, and to the biteline on a lateral side of the knitted component, wherein the second cable extends from the biteline on the medial side of the knitted component, through the throat area of the upper at a second location, and to the biteline on the lateral side of the knitted component, and wherein the first location is spaced from the second location in a longitudinal direction of the article of footwear.

18. A knitted component at least partially forming an upper for an article of footwear, the knitted component comprising:

a first knit layer and a second knit layer forming at least a midfoot region of the upper, the midfoot region of the upper comprising:

at least one knitted tubular structure comprising a secured portion where the first knit layer and the second knit layer are secured to each other and an unsecured portion where the first knit layer and the second knit layer are separable such that a channel is formed between the first knit layer and the second knit layer; and a cable at least partially extending within the channel of the at least one knitted tubular structure, wherein a first elasticity of the cable is at least 20% greater than a second elasticity of the knitted component.

19. The knitted component of claim 18, wherein the cable includes a first covered segment on a medial side of the knitted component, wherein the cable includes a second covered segment on a lateral side of the knitted component, and wherein the cable includes an exposed portion located in a throat area of the upper between the medial side and the lateral side of the knitted component.

20. The knitted component of claim 18, wherein the cable includes a first section and a second section, wherein the first section of the cable extends from a biteline of the article of footwear on a medial side of the knitted component, through a throat area of the upper at a first location, and to the biteline on a lateral side of the knitted component, wherein the second section of the cable extends from the biteline on the medial side of the knitted component, through the throat area of the upper at a second location, and to the biteline on the lateral side of the knitted component, and wherein the first location is spaced from the second location in a longitudinal direction of the article of footwear.

* * * * *